US005190004A

United States Patent [19]

Iwata

[11] Patent Number: 5,190,004

[45] Date of Patent: Mar. 2, 1993

[54] INTERNAL COMBUSTION ENGINE

[75] Inventor: Mitsunori Iwata, Osaka, Japan

[73] Assignee: Yanmar Diesel Engine Co., Ltd., Osaka, Japan

[21] Appl. No.: 757,534

[22] Filed: Sep. 11, 1991

[30] Foreign Application Priority Data

Sep. 12, 1990 [JP] Japan ..... 2-243015
Sep. 12, 1990 [JP] Japan ..... 2-243016

[51] Int. Cl.[5] ..... F01M 1/00

[52] U.S. Cl. ..... 123/196 R; 123/196 A; 123/364

[58] Field of Search ..... 123/195 C, 195 A, 198 R, 123/196 R, 196 A, 363, 364, 372, 374

[56] References Cited

U.S. PATENT DOCUMENTS 2,400,575 5/1946 Schwartz ..... 123/195 R
3,457,804 7/1969 Harkness ..... 74/604
3,895,619 7/1975 Potter ..... 123/374
4,974,562 12/1990 Ishii et al. ..... 123/198 C

FOREIGN PATENT DOCUMENTS

0475772A2 9/1991 European Pat. Off. .
1526472 5/1972 Fed. Rep. of Germany .
699753 2/1931 France .
1101580 10/1966 United Kingdom .

*Primary Examiner*—Noah P. Kamen
*Attorney, Agent, or Firm*—Wenderoth, Lind & Ponack

[57] ABSTRACT

Herein disclosed is an internal combustion engine in which a cylinder block at a side thereof opposed to a fly-wheel in the crankshaft direction has an opening covered with a side cover. A power take-off provided at a side of the side cover, and crankshaft has its one end supported by a bearing of the side cover. A lubricating oil pump is disposed in the cylinder block wall at the side of the fly-wheel.

5 Claims, 8 Drawing Sheets

INTERNAL COMBUSTION ENGINE

BACKGROUND OF THE INVENTION

1. Field of the Invention

The present invention relates to an internal combustion engine and, more particularly, to an internal combustion engine of the type, in which an opening at one side of a cylinder block in the crankshaft direction is covered with a side cover.

2. Description of the Prior Art

In the internal combustion engine of the above-specified type, in which an opening is formed at one side in the crankshaft direction and covered with a side cover, one bearing of the crankshaft is disposed in that side cover. Since a lubricating oil pump is driven from the crankshaft through a cam shaft, its drive shaft is arranged in parallel with the crankshaft and is attached to the side cover or the side of a gear mechanism for driving the cam shaft. Moreover, power for driving a service machine is extracted at the side of the side cover, and the fly-wheel is attached to the opposite or outer side of the cylinder block. FIGS. 7 and 8 show the structure of a cylinder block of an internal combustion engine having a side cover structure according to the prior art.

In FIGS. 7 and 8, reference numeral 1 designates a cylinder block, and numeral 2 designates a side cover covering the opening of the cylinder block 1. To a generally middle portion of the cylinder block 1 in a direction perpendicular to the shaft, as viewed in a top plan view, there is attached a crankshaft 5 which has its one end supported in the side cover 2 through a plain bearing 3 and its other end supported in the wall of the cylinder block 1 at the side opposed to the side cover 2 by a ball bearing 4. A cam shaft 6 is arranged to one side of the crankshaft 5, and an intermediate shaft such as a balancer shaft 7 is arranged to the other side, so that the cam shaft 6 may be driven from the crankshaft 5 through a gear mechanism 8 which is attached to the crankshaft 5 and the cam shaft 6 at the side of the side cover 2. Moreover, the balancer shaft 7 is driven through a gear 9 which is attached to the crankshaft 5 and the balancer shaft 7 at the side opposed to the side cover 2. A case 10 is formed in the side cover 2 below the cam shaft 6, and a lubricating oil pump 11 which has its drive shaft 12 projecting into the cylinder block 1 is accommodated in the case 10. At the same time, a driven gear 13 fixed on the drive shaft 12 meshes with the gear mechanism 8 on the cam shaft 6 to drive the lubricating oil pump 11. To the leading end of the driven gear 13, there is attached a governor weight assembly 14 for regulating the speed. The crankshaft 5 has its end 15 projecting from the side cover 2 to provide a power extraction side, and the side cover 2 at this power extraction side is equipped at its outside with a flange 16 to be connected directly to a service machine. The (not-shown) fly-wheel is arranged at the end portion of the crankshaft 5 at the side opposed to the flange 16.

On the other hand, a speed control system of a Diesel engine is composed of a not-shown fuel injection pump, the aforementioned governor weight assembly 14, a self regulating speed mechanism for connecting the fuel injection pump and the governor weight assembly 14, and a control mechanism for adjusting the injection rate. Of these, the governor weight assembly 14 is mounted on the same shaft 12 as that of the lubricating oil pump, as described above, and is positioned at the side of the side cover 2. On the other hand, the not-shown self regulating speed mechanism and injection rate adjusting control mechanism are mounted together with the fuel injection pump in the body wall of the cylinder block 1 at the side opposed to the governor weight assembly 14 and are interlocked with the governor weight assembly 14.

In the structure of the prior art thus far described, the lubricating oil pump 11 is disposed in the side cover 2 at the power extraction side, and the driven gear 13 of the drive shaft 12 projecting from the side cover 2 into the cylinder block 1 is arranged to mesh with the gear 8 on the cam shaft 6.

Firstly, this structure has a defect in that assembly of the side cover 2 is seriously troublesome. This assembly is shown in FIG. 9. The lubricating oil pump 11 is assembled together with the drive shaft 12 and the parts on the drive shaft 12 so as to cover the opening of the cylinder block 1. At this time, it is necessary to bring the driven gear 13 on the drive shaft 12 and the gear 8 on the cam shaft 6 into meshing engagement with each other. It is rare, however, to insert the gears with their teeth completely meshing with each other. Considerable troubles are encountered in turning at least one of the gears to establish the meshing engagement by inserting the hand into a clearance 17 present before the side cover 2 is brought into abutment against the wall of the cylinder block 1.

Secondly, the lubricating oil pump 11 is attached to the side cover 2 at the power extraction side of the service machine. As a result, the flange 16 to be connected directly to some service machine will axially interfere, if disposed outside of the side cover 2, with a lubricating oil pump cover 18 which is also fixed on the outer side of the side cover 2, so that the lubricating oil pump 11 cannot be removed for inspection. As a result, the direct connection has to be given up for such service machine. In this case, it is conceivable to change the position of the flange 16 so as to avoid such interference. As a matter of fact, this change is difficult because the mounting sizes of the service machine and the flange and the direct socket connection are specified in advance.

Generally speaking, moreover, the lubricating oil discharged from the aforementioned lubricating oil pump 11 is guided from a passage formed in the wall portion of the cylinder block 1 or the side cover 2 into the bearing portion of the crankshaft 5, and is then fed to the crank pin via a bore hole formed in the crankshaft 5. In order that the lubricating oil may thus flow into the bored hole in the crankshaft 5, the bearing has to be of the plain type. Since, however, the plain bearing 3 is used only as the bearing of the side cover in the prior art, the passage from the lubricating oil pump 11 to the bearing has to be formed in the side cover 2. This passage 19 has to be obliquely machine because the lubricating oil pump 11 is disposed below the cam shaft 6 positioned obliquely above the crankshaft 5, as shown in FIG. 8. As a result, the machining is difficult, and the parting direction is complicated, even when die casting is employed, thereby causing the production costs to be high.

In addition, the driven gear 13 of the pump drive shaft 12 is in meshing engagement with the cam shaft gear 8 at the side of the side cover 2. This cam shaft gear 8 must have a large diameter because it rotates at half the speed of the crankshaft 5. As a result, the drive gear 13 must be positioned apart from the crankshaft, thus restricting the positioning of the lubricating oil pump 11. Thus, it is impossible to position the pump most efficiently.

In the prior art, moreover, the lubricating oil filter to be disposed at this side of the lubricating oil pump 11 is also disposed at the side of the side cover 2 so that it is attached and detached from the side of the service machine. Since it is difficult to integrate the case for supporting the lubricating oil filter with the side cover, it has to be formed either separately or integrally with the cylinder block 1 so that it is inserted in the vicinity of and in parallel with the side cover. The former arrangement is beset by the problem that the number of parts will increase. In the latter arrangement, the passage for introducing the lubricating oil to the bearing of the side cover 2 is cut at the joint between the side cover 2 and the cylinder block 1 so that this cut portion has to be specially sealed up. Thus, the latter arrangement also results in an increased number of parts.

In the Diesel engine, on the other hand, it is necessary to make adjustments, e.g., to set the maximum fuel injection rate at the stage in which the aforementioned speed control system is assembled. In the prior art, as described above, the governor weight assembly 14 is disposed at the side cover 2, whereas the fuel injection pump and the self regulating speed mechanism are disposed in the cylinder block 1. As a result, the speed control system is not completed until the side cover 2 is attached, thereby creating a problem in that such adjustment cannot be accomplished before the side cover 2 is attached. Thus, the adjustments have to be done under a load run in the completed state in which the cylinder block 1 is assembled and in which the cylinder head and so on are attached. This load run required after assembly involves most of the steps of the assembly process.

As described above, on the other hand, the governor weight assembly 14 and another mechanism are separately attached to the side cover 2 and the body of the cylinder block 1. As a result, their assemblies have to be separately accomplished, and the connections among the governor weight assembly 14, the self speed regulating mechanism and the adjusting control mechanism have to be accomplished at the stage in which the side cover 2 is attached. Thus, another defect is that the assemblies are troublesome and poor in accuracy.

SUMMARY OF THE INVENTION

It is, therefore, an object of the present invention to provide an internal combustion engine for which it is possible to easily assemble the lubricating oil pump into the cylinder block.

Another object of the present invention is to provide a flange which is formed at the side of the side cover for connecting a service machine directly and which is freed from any interference with the lubricating oil pump so that it can ensure direct connection with a service machine having any flange shape.

Still another object of the present invention is to provide a structure for an internal combustion engine, which can be easily formed with a lubricating oil passage from the lubricating oil pump to the crankshaft and reinforce the cylinder block with a rib for forming the passage.

A further object of the present invention is to provide a structure for an internal combustion engine, for which the lubricating oil pump can be arranged most efficiently without being obstructed by the cam shaft gear.

A further object of the present invention is to provide a structure for an internal combustion engine, which allows the lubricating oil filter to be attached and detached without being obstructed by the service machine and for which the number of parts can be reduced.

A further object of the present invention is to provide a structure for an internal combustion engine having a speed control system which can be adjusted for maximum fuel injection rate or the like before the assembly of the cylinder block.

A further object of the present invention is to provide an internal combustion engine for which the assembly is facilitated and the assembling accuracy is improved by assembling the self regulating speed mechanism and the adjusting control mechanism in advance in the mounting bed separated from the cylinder body.

According to a first feature of the present invention, there is provided an internal combustion engine of the type, in which a cylinder block at the side opposed to the fly-wheel in the crankshaft direction has its opening covered with a side cover, in which power can be extracted from the side of the side cover, and in which the crankshaft has its one end supported by a bearing of the side cover, wherein a lubricating oil pump is disposed in the cylinder block wall at the side of the fly-wheel.

According to a second feature of the present invention, there is provided an internal combustion engine of the type, in which one cylinder block in the crankshaft direction is equipped therein with a gear mechanism for driving a cam shaft or an intermediate shaft, wherein a gear for driving a lubricating oil pump is interlocked with the intermediate shaft within a cylinder block opposed to the gear mechanism in the crankshaft direction.

According to a third feature of the present invention, there is provided an internal combustion engine of the type, in which a cylinder block at the side opposed to the fly-wheel in the crankshaft direction has its opening covered with a side cover, wherein a lubricating oil filter has its case formed in and integrally with the cylinder block at the side opposed to the side cover.

According to a fourth feature of the present invention, there is provided an internal combustion engine of the type, in which a cylinder block at the side opposed to the fly-wheel in the crankshaft direction has its opening covered with a side cover and in which power can be extracted from the side of the side cover, wherein a lubricating oil filter is so disposed in the opposite cylinder block that it can be removed from the side opposed to the power extracting side.

According to a fifth feature of the present invention, there is provided an internal combustion engine of the type, in which a cylinder block at one side in the crankshaft direction has its opening covered with a side cover, wherein a fuel injection pump, a governor weight assembly, a self regulating speed mechanism for connecting said fuel injection pump and the governor weight assembly, a mechanism for adjusting the injection rate, and a maximum injection rate limit mechanism are mounted at the cylinder block side.

According to a sixth feature of the present invention, there is provided an internal combustion engine wherein a fuel injection rate adjusting control lever, and an interlocking mechanism including a lever for connecting the control lever, a fuel injection pump and a governor weight assembly are assembled together in a mounting bed separate from a cylinder block and are mounted through the mounting bed in said cylinder block.

BRIEF DESCRIPTION OF THE DRAWINGS

Other objects and resultant advantages of the present invention will be clearly understood from the following description to be made with reference to the accompanying drawings, in which.

DESCRIPTION OF THE PREFERRED EMBODIMENT

Figure 4:
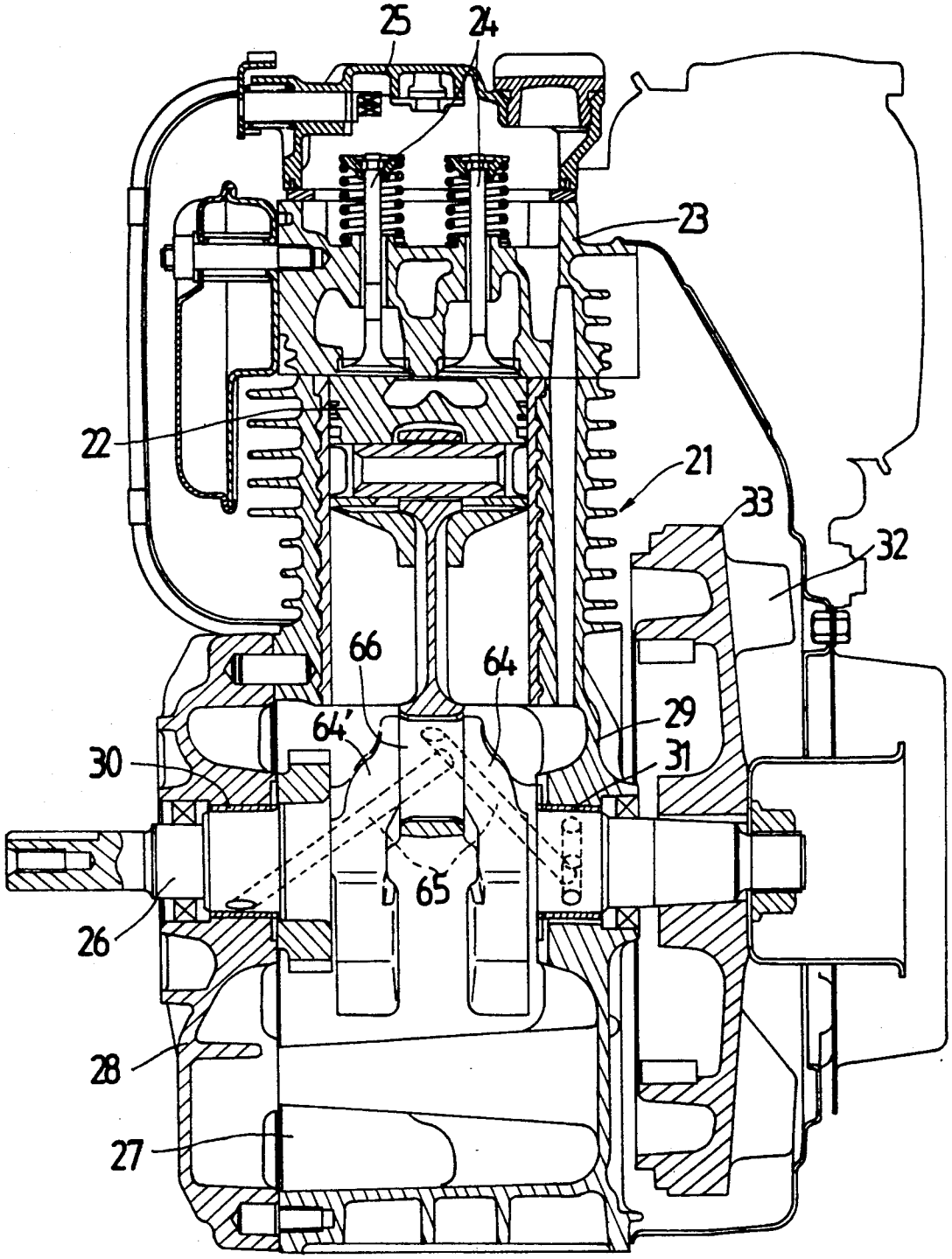
FIG. 4 is a vertical section showing the overall structure of an internal combustion engine.
Figure 5:
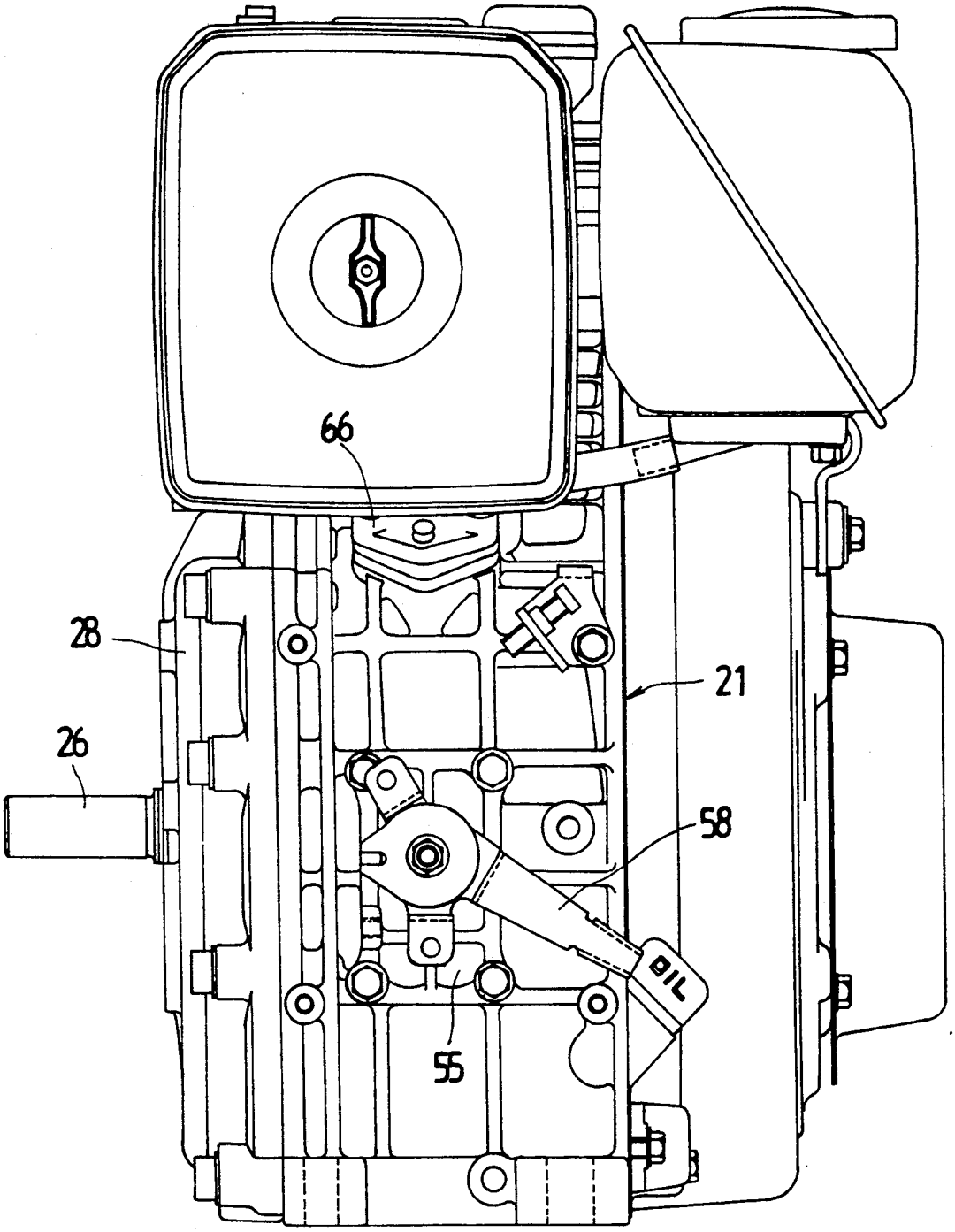
FIG. 5 is a side elevation showing the whole engine and taken from the side of a speed control system.

FIG. 4 is a longitudinal section showing an internal combustion engine according to the present invention and taken in the direction of a crankshaft. In FIG. 4: reference numeral 21 designates a cylinder block; numeral 22 a piston fitted in a cylinder in the upper portion of the cylinder block 21; numeral 23 a cylinder head disposed on the top face of the cylinder block 21; and numeral 24 an intake valve or an exhaust valve fitted in the cylinder head 23. A rocker arm cover 25 is attached to the top of the cylinder head 23. Numeral 26 designates the crankshaft which is supported in the cylinder block 21. This cylinder block 21 is opened at its one side of the crankshaft 26, and this opening 27 is covered with a side cover 28. Moreover, the crankshaft 26 has its one end inserted in the side cover 28 and its other end inserted in an opposite cylinder block wall 29 such that its two ends are supported by plain bearings 30 and 31. At the side of the cylinder block wall 29, a fly-wheel 33 carrying a cooling fan 32 is attached to that end of the crankshaft 26 which projects from the cylinder block wall 29. The end of the crankshaft 26 projecting from the side cover 28 is for extracting power (i.e. is a power take-off shaft) and can be connected directly to a variety of service machines.

Figure 1:
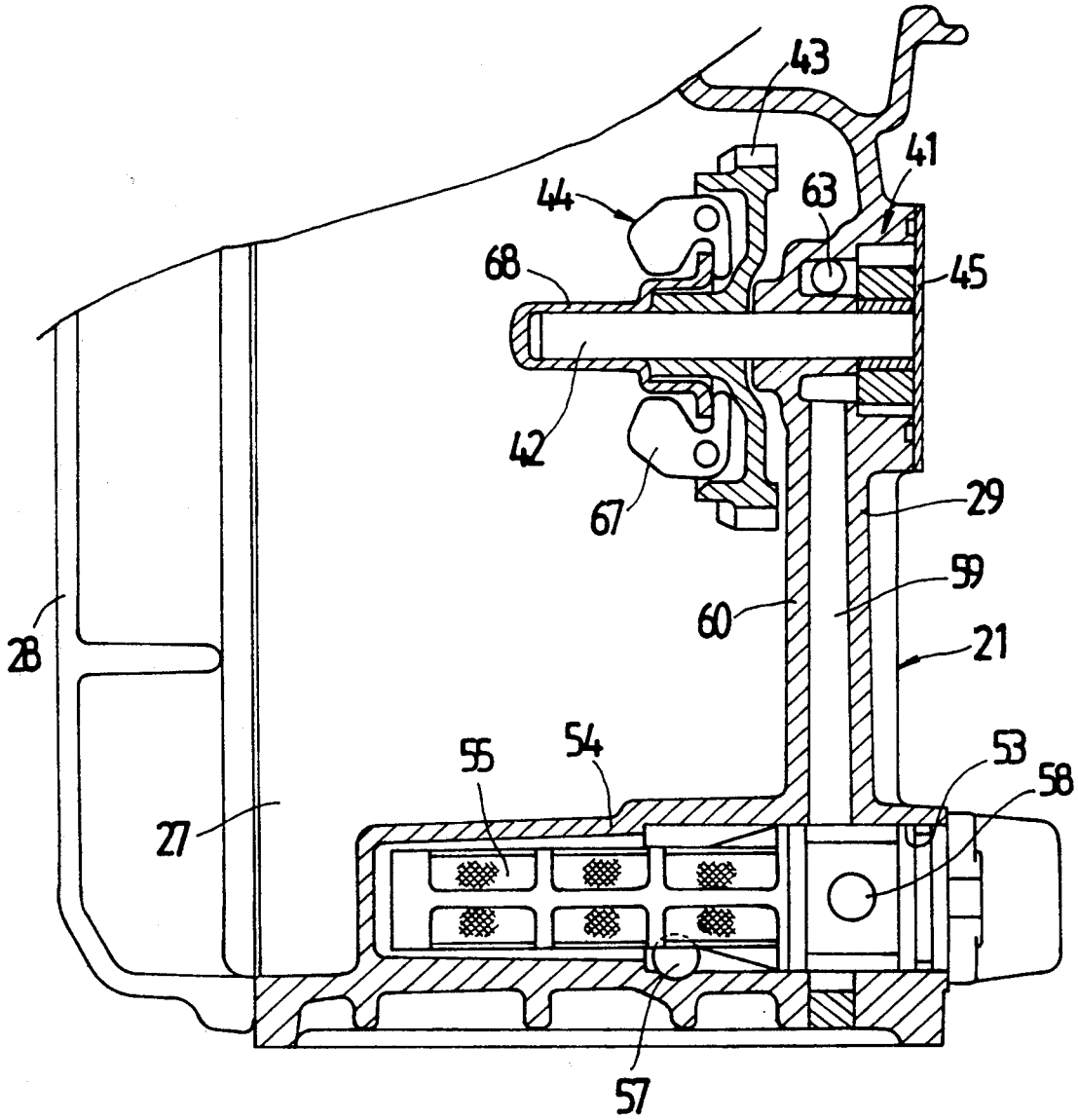
FIG. 1 is a vertical section showing an essential portion of a cylinder block having a lubricating oil pump attached thereto.
Figure 2:
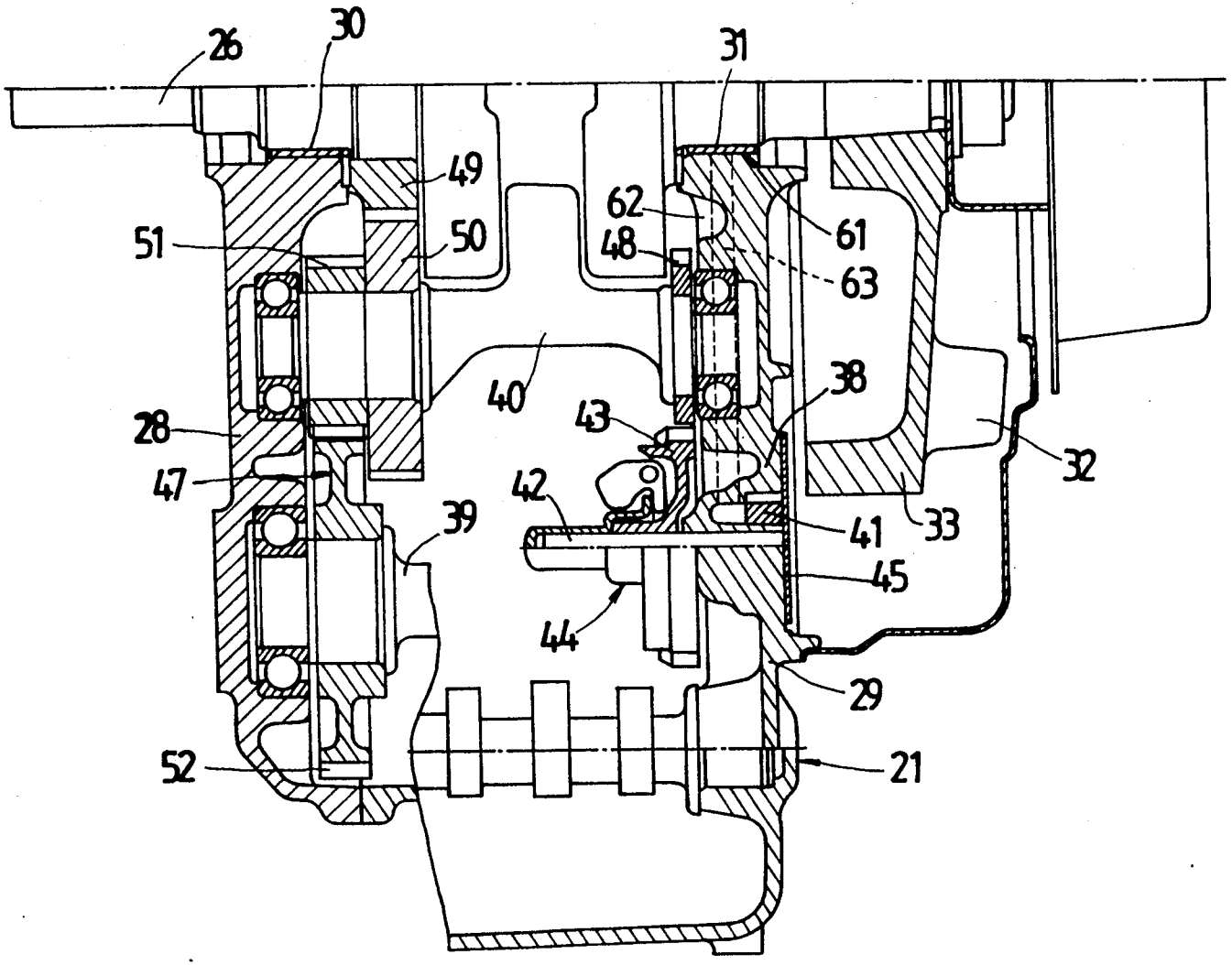
FIG. 2 is a horizontal section showing the same essential portion.
Figure 3:
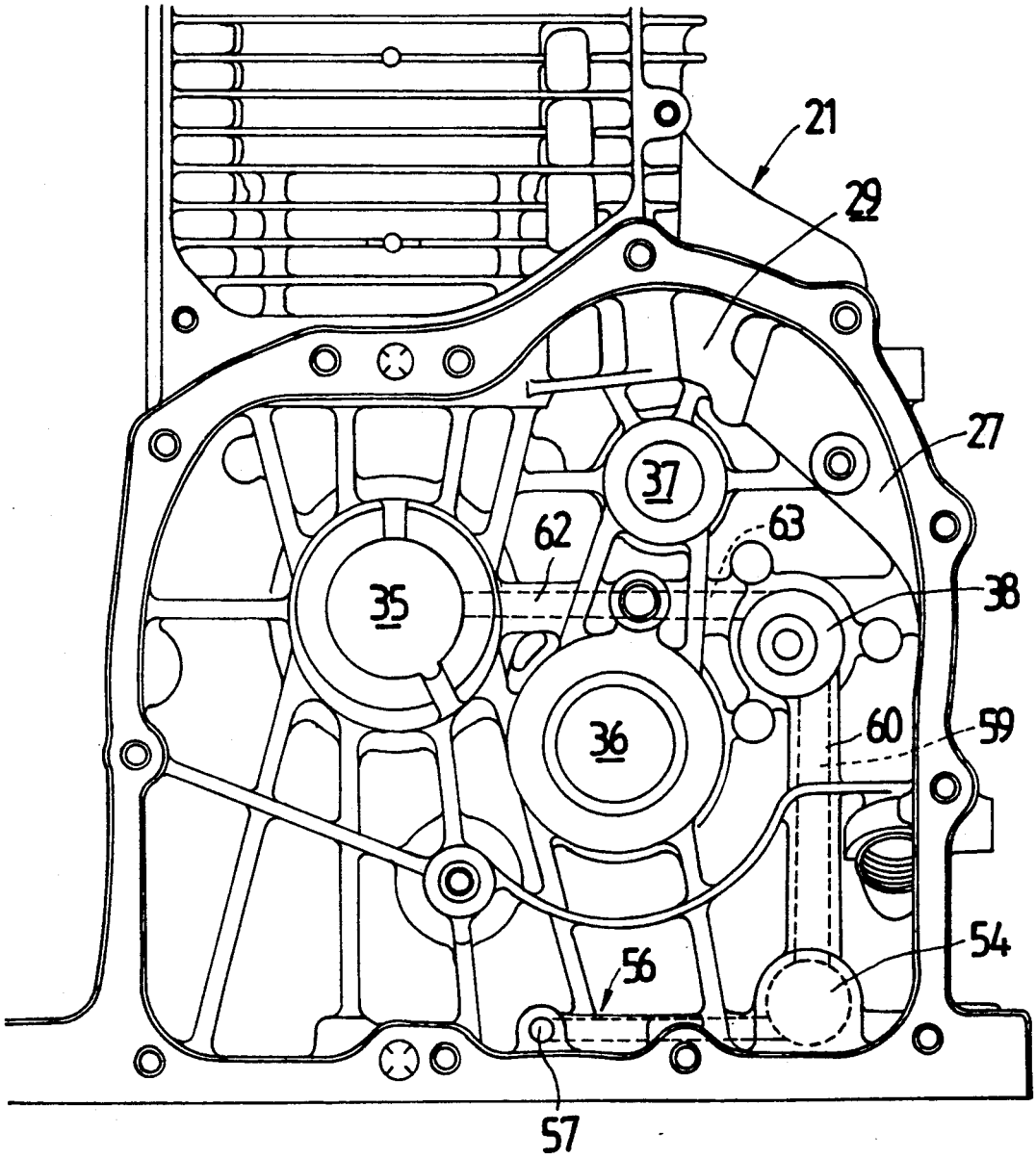
FIG. 3 is a side elevation showing the overall structure of the cylinder block and taken from the opening thereof.

FIG. 3 is a side elevation showing the cylinder block 21 and taken from the side of the opening 27. The cylinder block wall 29 is formed, at the side opposed to the opening 27, with a crankshaft fitting hole 35 which extends on the cylinder center line. The cylinder block wall 29 is further formed with a balancer shaft fitting hole 36, which is located obliquely below the hole 35, and a cam shaft fitting hole 37 which is located obliquely above the hole 35. Integrally formed is a lubricating oil pump case 38 which is located at the side opposed to the crankshaft 26 with respect to the cam shaft fitting hole 37 and the balancer shaft fitting hole 36. The bearing structures for a cam shaft 39 and a balancer shaft 40 are shown in FIG. 2. As shown in FIG. 2, moreover, the body assembly of a pump 41 such as the pump gear is inserted from the outside at the side of the aforementioned fly-wheel 33. The oil pump 41, disposed in the pump case 38, has its drive shaft 42 inserted from the side of the fly-wheel 33 such that it protrudes into the cylinder block 21. A pump driven gear 43 and a speed regulating fly-weight assembly 44 are attached to that drive shaft 42 from the side of the opening 27. Numeral 45 designates a cover covering that opening of the pump case 38, which is opened in the outer side of the cylinder block 21. The pump driven gear 43 meshes with a drive gear 48 on the balancer shaft 40 at the side of the cylinder block wall 29 or at the side opposed to a driving gear mechanism 47 such as the cam shaft 39 disposed at the side of the side cover 28, so that the pump driven gear 43 is driven through the drive gear 48 by the balancer shaft 40 acting as an intermediate shaft. Incidentally, the gear mechanism 47 at the side of the aforementioned side cover 28 is composed of: a balancer gear 50 fixed on the balancer shaft 40 and meshing with a crank gear 49 for driving the balancer shaft 40; and a cam shaft drive and driven gears 51 and 52 fixed on the balancer shaft 40 and the cam shaft 39 and meshing with each other for driving the cam shaft 39 from the balancer shaft 40.

The cylinder block wall 29 just below the aforementioned pump case 38 is integrally formed with a filter case 54 which has an insertion hole 53 at the side of the aforementioned fly-wheel 33 so that the filter case 54 extends along the bottom wall of the cylinder block 21. Moreover, a lubricating oil filter 55 is inserted from the insertion hole 53 and fitted in the case 54. In communication with the inside of the filter case 54, there is formed a suction passage 57 for sucking the lubricating oil from the center of the oil pan in the bottom of the cylinder block 29. The suction passage 57 is defined by a rib 56 which is formed along the bottom wall of the cylinder block 21 and which has an L-shape as viewed in top plan view. The lubricating oil sucked from the suction passage 57 is guided to the outer circumference of the lubricating oil filter 55 in the filter case 54 and is sucked via the inside of the lubricating oil filter 55 to the lubricating oil pump 41 from an exit 58 which is formed in the vicinity of the end portion of the lubricating oil filter 55 at the side of the aforementioned insertion hole 53. In the cylinder block wall 29 at the side of that lubricating oil pump 41, moreover, there is formed a vertical communication passage 59 for providing communication between the filter case 54 and the lubricating oil pump 41. The communication passage 59 is defined by a rib 60 which is formed integrally with the cylinder block wall 29, so that the lubricating oil having passed through the lubricating oil filter 55 may be sucked therethrough into the lubricating oil pump 41. From the case 38 of the lubricating oil pump 41 and across a crankshaft bearing portion 61 of the cylinder block 21, moreover, there is integrally formed a horizontal rib 62 which is formed therein with a discharge passage 63 for feeding the lubricating oil to the crankshaft bearing portion 61. After having lubricated the plain bearing 31 of the bearing portion 61, the lubricating oil is fed to a crank pin 66 via a hole 65 which is formed in the arm 64 (as shown in FIG. 4) of the crankshaft 26 and further from the arm 64' at the opposite side to the crankshaft bearing 30 of the side cover 28 also at the opposite side.

Figure 6:
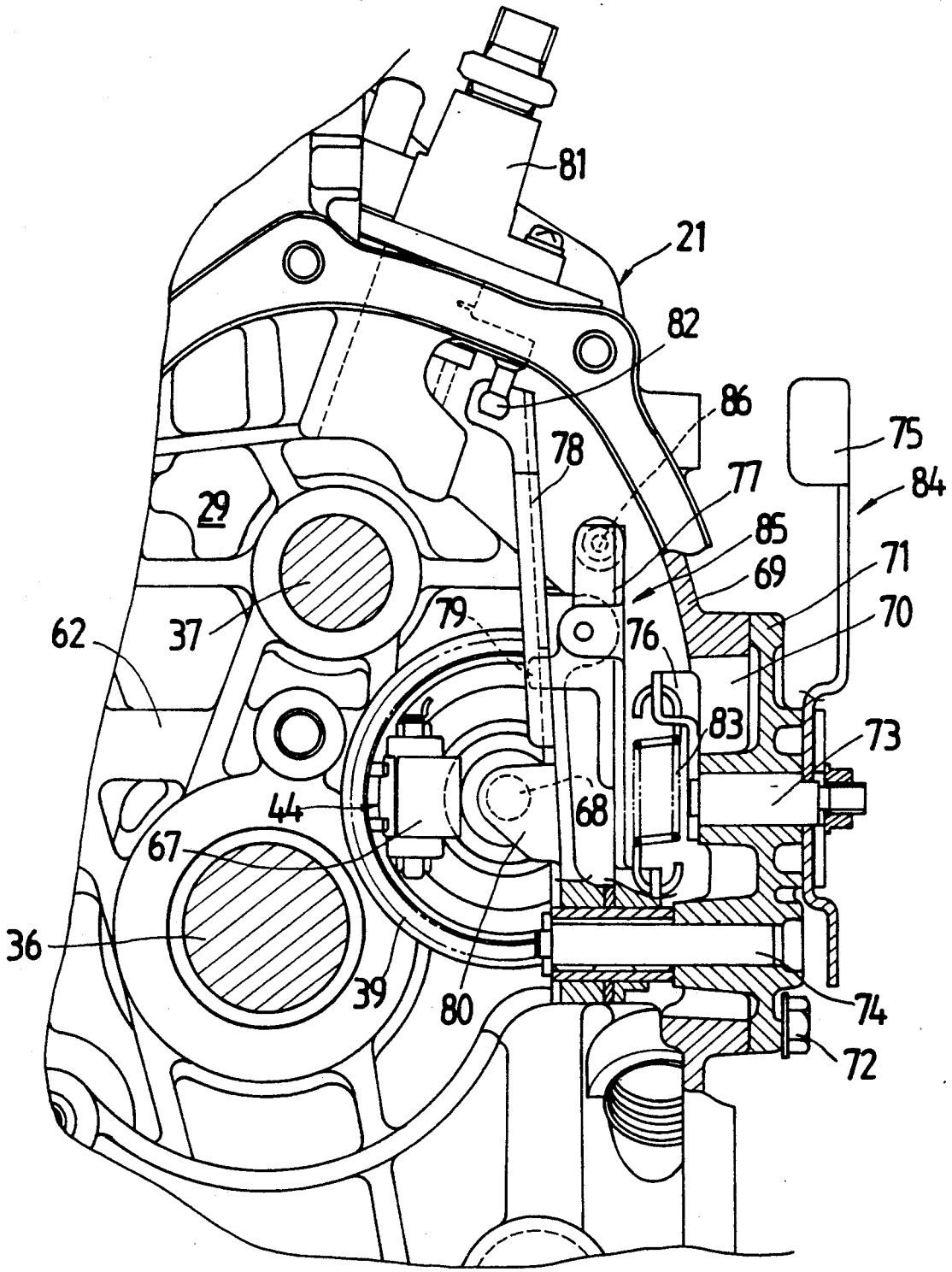
FIG. 6 is a section showing an essential portion of the same and vertically taken at the speed control system.
Figure 7:
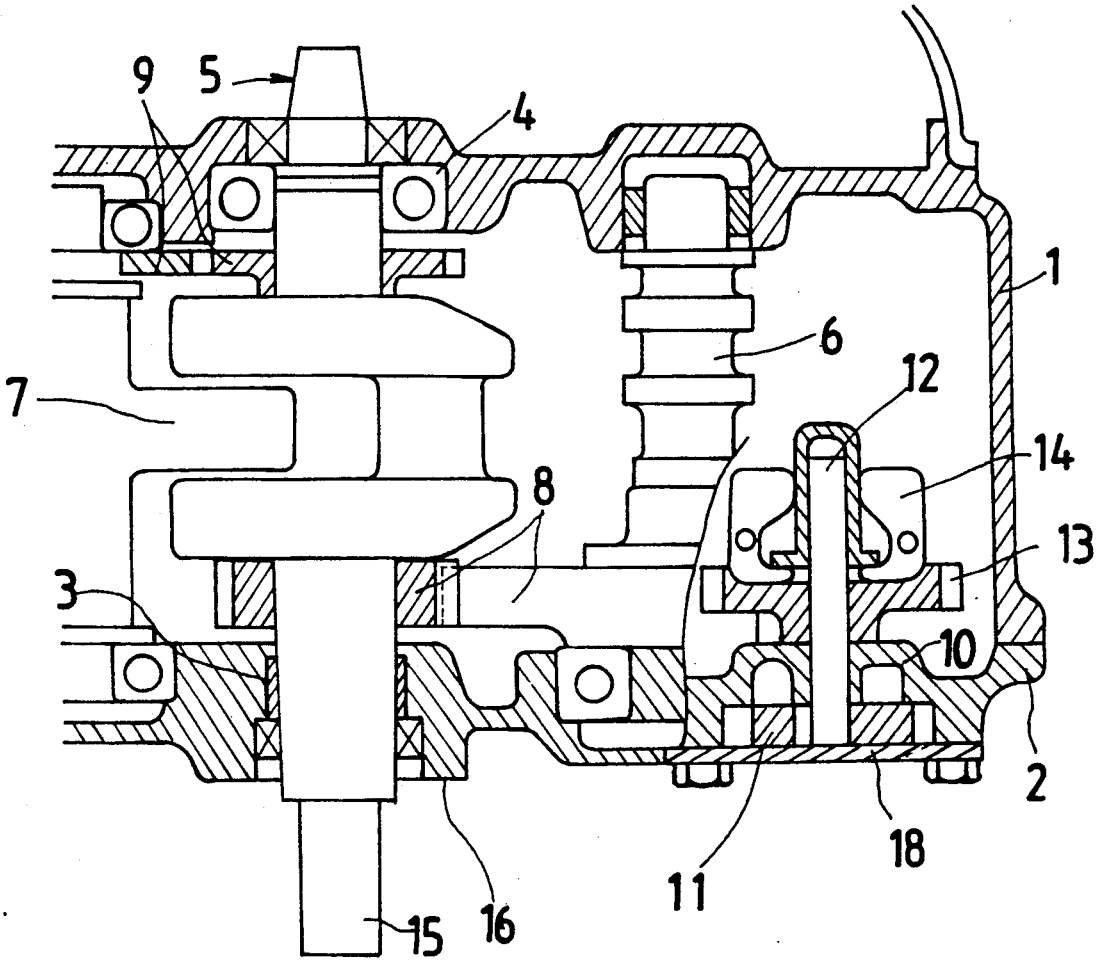
FIG. 7 is a horizontal section showing an essential portion of a cylinder block according to an example of the prior art.
Figure 8:
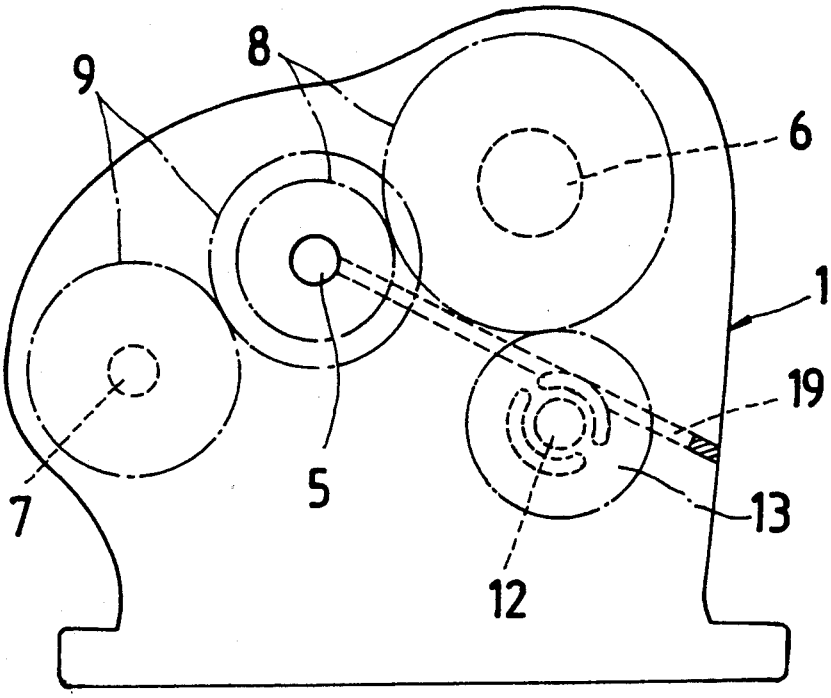
FIG. 8 is a side elevation showing the same cylinder block of the prior art.
Figure 9:
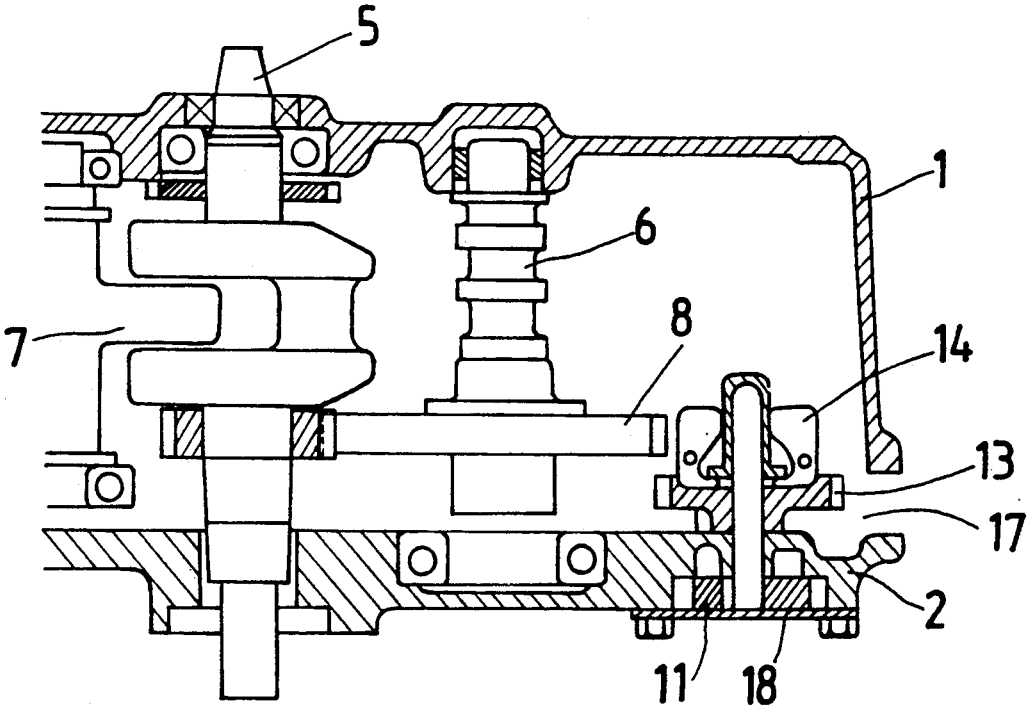
FIG. 9 is a horizontal section showing a method of assembling the side cover according to the prior art.

Next, the governor weight assembly 44 is composed of a governor weight 67 and a governor spindle 68. As shown in FIG. 6, a wall portion 69, which is in parallel with the crankshaft 26 perpendicular to the wall 29 of the cylinder block 21 having the governor weight assembly 44 attached thereto, is formed with an opening 70 for mounting a lever and so on. A plate-shaped mounting bed 71 is so fixed from the outside by means of bolts 72 as to close the opening 70. The mounting bed 71 is formed with a first control shaft 73 and a second control shaft 74 which are so arranged in upper and lower positions and in parallel with each other as to extend therethrough between the inside and the outside. A control lever 75 is attached to the outer end portion of the first control shaft 73, and an interlocking lever 76 is attached to the inner end portion of the cylinder block 21. To the second control shaft 74, on the other hand, there are so attached in the cylinder block 21 a first control lever 77 and a second control lever 78 that they can rotate together relative to the second control shaft 74. The bases of the first control lever 77 and the interlocking lever 76 are connected by a governor spring 83, and the first control lever 77 and the second control lever 78 have their middle portions engaging with each other through a projection 79. Moreover, the spindle 68 of the aforementioned governor weight assembly 44 is arranged to face a pressure receiving portion 80 which is projected sideways from near the base of the second control lever 78. Reference numeral 81 designates a fuel injection pump which is screwed downward into the cylinder block 21. The second control lever 78 is connected to the fuel injection pump 81 while engaging with an injection adjusting control pin 82.

With the structure thus far described, both an injection adjusting control mechanism 84 composed of the control lever 75 and the first control shaft 73, and a self adjusting speed mechanism 85 composed of the second control shaft 74, the spring 83, the first control lever 77 and the second control lever 78 are attached to the cylinder block 21 such that they are assembled in advance with the mounting bed 71. Despite this fact, however, this mounting bed 71 may be omitted if the structure is to be applied only to an internal combustion engine of the type, in which a cylinder block, having a crankshaft mounted therein, has an opening formed in one side thereof in a crankshaft direction, and said opening is covered with a side cover, wherein a fuel injection pump, a governor weight assembly, a self regulating speed mechanism for connecting the fuel injection pump and the governor weight assembly, a mechanism for adjusting the injection rate, and a maximum injection rate limit mechanism are mounted at the side of the cylinder block opposite the side thereof having the side cover.

In a manner to correspond to the upper end of the first control lever 77, on the other hand, there are arranged a fuel limiter 86 which is attached to the wall 29 at the same side as the lubricating oil pump 36 of the cylinder block 21 for limiting the maximum injection rate. By adjusting this fuel limiter 86, the limit position of the turning range of the first control lever 77 in a direction to increase the injection rate is changed.

The embodiment thus far described exemplifies the best mode of the present invention. Thus, the present invention should not be limited thereto but can be modified in various manners within the scope thereof, which is to be specified in the claims.

What is claimed is:

1. An internal combustion engine of the type in which a cylinder block, having a crankshaft mounted therein, is equipped therein with a gear mechanism for driving an intermediate shaft which is mounted in a crankshaft direction, wherein a gear for driving a lubricating oil pump is interlocked with said intermediate shaft within said cylinder block on a side of said cylinder block opposed to said gear mechanism in the crankshaft direction.

2. An internal combustion engine of the type in which a cylinder block, having a crankshaft mounted therein, has an opening formed in a side thereof opposed to a fly-wheel in a crankshaft direction and said opening is covered with a side cover, wherein a case for a lubricating oil filter is formed in and integrally with the cylinder block at a side thereof opposed to said side cover.

3. An internal combustion engine of the type in which a cylinder block, having a crankshaft mounted therein, has an opening formed in a side thereof opposed to a fly-wheel in a crankshaft direction and said opening is covered with a side cover, and in which power can be extracted from the side of said cylinder block having said side cover, wherein a lubricating oil filter is disposed in said cylinder block at a side thereof opposite said side cover, such that said filter can be removed from the side of the cylinder block opposed to the power extracting side.

4. An internal combustion engine of the type in which a cylinder block, having a crankshaft mounted therein, has an opening formed in one side thereof in a crankshaft direction, and said opening is covered with a side cover, wherein a fuel injection pump, a governor weight assembly, a self regulating speed mechanism for connecting said fuel injection pump and said governor weight assembly, a mechanism for adjusting the injection rate, and a maximum injection rate limit mechanism are mounted at the side of said cylinder block opposite the side thereof having said side cover.

5. An internal combustion engine of the type in which a fuel injection pump and a governor weight assembly are attached to a cylinder block, wherein a fuel injection rate adjusting control lever, and an interlocking mechanism including a lever for connecting said control lever are assembled together with a mounting bed separate from said cylinder block and are mounted through said mounting bed in said cylinder block.

* * * * *